United States Patent [19]

Rumpf

[11] Patent Number: 4,829,687

[45] Date of Patent: May 16, 1989

[54] CHECK-OUT LANE SIGN

[75] Inventor: Arthur H. Rumpf, Oconomowoc, Wis.

[73] Assignee: KCS Industries Inc., Milwaukee, Wis.

[21] Appl. No.: 117,336

[22] Filed: Nov. 6, 1987

[51] Int. Cl.[4] ..... G09F 15/00

[52] U.S. Cl. ..... 40/606; 248/516; 248/288.3

[58] Field of Search ..... 40/606, 492, 617, 601, 40/610; 248/288.3, 516; 186/59, 68; 116/52

[56] References Cited

U.S. PATENT DOCUMENTS

| | | | |
|---|---|---|---|
| 76,706 | 4/1868 | Breevort | 248/288.3 |
| 435,696 | 9/1890 | Hoffmann | 40/617 |
| 1,371,079 | 3/1921 | Drosin | 40/617 |
| 1,637,305 | 7/1927 | Hendsch | 40/606 |
| 2,178,751 | 11/1939 | Glasgow | 40/606 |
| 3,540,406 | 11/1970 | Dexter | 248/516 |
| 4,265,336 | 5/1981 | Foster | 186/68 |

FOREIGN PATENT DOCUMENTS

| | | | |
|---|---|---|---|
| 7433 | 4/1900 | United Kingdom | 248/288.3 |

*Primary Examiner*—Gene Mancene
*Assistant Examiner*—Cary E. Stone
*Attorney, Agent, or Firm*—Andrus, Sceales, Starke & Sawall

[57] ABSTRACT

A check-out lane sign for a supermarket or other shopping establishment. The sign includes a molded plastic body to be mounted on a surface adjacent the check-out lane, and the body defines a generally spherical socket. The outer surface of the body is formed with at least one slot, which communicates with the socket. A ball is mounted for rotation within the socket and a rod connected to the ball extends outwardly through the slot in the body and carries a panel. One side of the panel preferably carries verbage indicating that the check-out lane is closed. By moving the rod within the slot, the sign can be moved from a first position where it extends across the check-out lane to a second position where it extends alongside the check-out lane and will not interfere with movement of items along the check-out lane.

13 Claims, 1 Drawing Sheet

FIG. 1
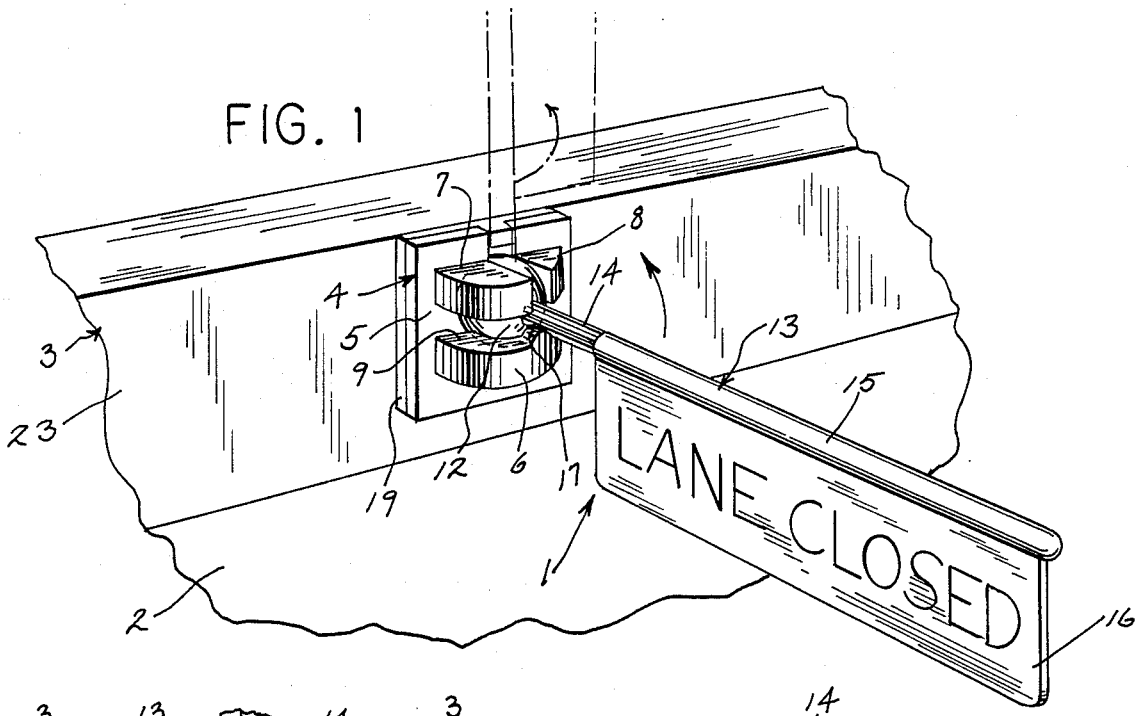
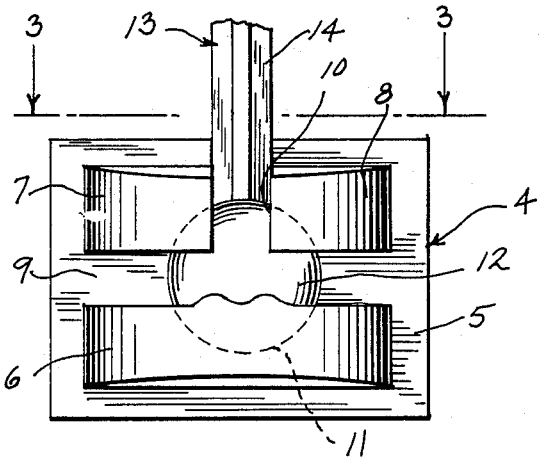
FIG. 2
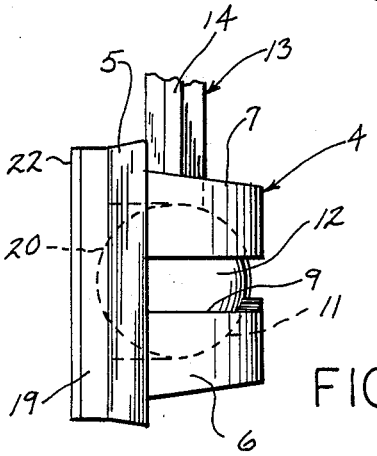
FIG. 4
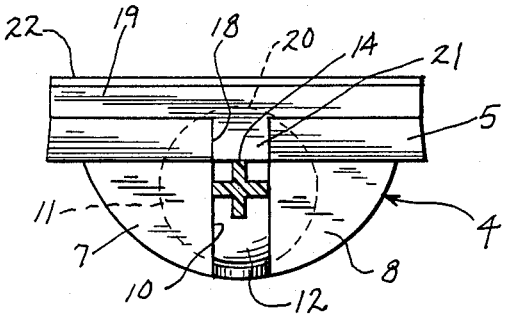
FIG. 3
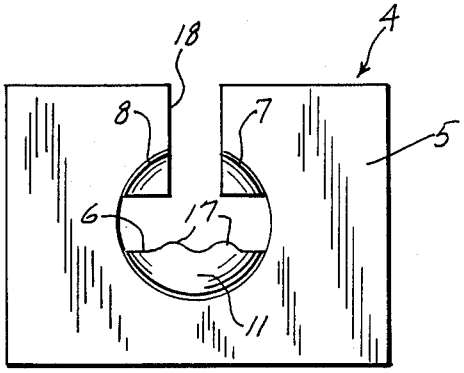
FIG. 5

CHECK-OUT LANE SIGN

BACKGROUND OF THE INVENTION

Supermarkets, discount department stores, and the like normally include check-out lanes or counters. At any one time, one or more check-out lanes may be closed, and to indicate the closure, a sign is normally placed on the lane which bears the words "lane closed" or similar verbage. In the past, the signs have taken the form of bars that are placed across the check-out lane, chains which carry a sign, or self-supporting signs that are placed on the lane.

Problems have arisen with the use of such signs in that it is necessary for the employee to store the sign when it is not in use, and frequently the signs are misplaced or lost so that no sign is available to indicate the lane closure. In addition, because of the frequent handling of the signs, breakage frequently occurs.

SUMMARY OF THE INVENTION

The invention is directed to a check-out lane sign which can be permanently affixed to a surface bordering the lane and can be selectively moved between a position where the sign extends across the lane, indicating that the lane is closed, and a storage position where the sign will not interfere with movement of items on the lane.

In accordance with the invention, the sign includes a molded plastic body having an inner surface which is adapted to be attached to either a horizontal or vertical surface bordering the check-out lane. The body defines a generally spherical socket and at least one slot is formed in the outer surface of the body and communicates with the socket. Mounted for rotation within the socket is a ball, and a rod secured to the ball extends outwardly through the slot and carries a panel. One side of the panel will normally include verbage such as "lane closed" while the opposite side of the panel can bear verbage, such as, "lane open" or advertising copy.

By moving the rod within the slot, the panel can be moved from a first position where it extends across the check-out lane to a second storage position where the panel will be positioned alongside the lane and will not interfere with movement of items along the lane.

The sign of the invention can be attached to any surface adjacent the check-out lane, such as, for example, either the horizontal or vertical surface of the side rail bordering the lane, or a surface of a cash register located adjacent the lane.

Not only can the sign be moved between the operating and storage positions, but by rotating the rod about its axis opposite sides of the panel can be exposed to the customer so that in its storage position, advertising copy can be visible to the customer.

In the preferred form of the invention, the body is formed with a pair of slots, one extending through 180°, and the second extending through 90° and intersecting the first slot. With this construction, the panel can be moved to various horizontal or vertical positions to accommodate any mounting arrangement as well as usages of the sign.

Other objects and advantages will appear in the course of the following description.

DESCRIPTION OF THE DRAWINGS

The drawings illustrate the best mode presently contemplated of carrying out the invention. In the drawings:

FIG. 1 is a perspective view of a typical check-out lane incorporating the sign of the invention;

FIG. 2 is a plan view of the body of the sign;

FIG. 3 is a view taken along line 3—3 of FIG. 2;

FIG. 4 is an end view of the body; and

FIG. 5 is a bottom view of the body.

DESCRIPTION OF THE ILLUSTRATED EMBODIMENT

FIG. 1 shows a check-out sign 1 of the invention as associated with a check-out line as may exist in a supermarket, discount department store, or the like. The check-out line includes a generally flat surface 2, which may be either a conveyer belt or a counter top, and the surface 2 is bordered by a pair of side rails 3.

Sign 1 includes a body 4, preferably molded from a plastic material, and the body is composed of a generally rectangular inner section 5, and a group of guide members 6, 7, and 8 extend outwardly from the outer surface of section 5. Guide 6 is spaced from guides 7 and 8 to form a slot 9 which extends through an arc of approximately 180° and similarly, guides 7 and 8 are spaced apart to provide a second slot 10 that intersects slot 9 and extends through an arc of about 90°.

The inner section 5 and guide members 6, 7, and 8 define a portion of a generally spherical socket 11, which receives a ball or sphere 12. As shown in FIG. 2, one end of a rod 13 is secured to ball 12, and rod 13 extends outwardly through one of the slots 9 or 10.

The inner portion 14 of rod 13 has a generally x-shaped cross-sectional configuration, while the outer portion 15 of rod 13 is generally circular in cross-sectional configuration. The x-shaped configuration 13 provides added strength and rigidity for the rod in the area where the rod is subjected to greatest stress.

Mounted on the outer portion 15 of rod 13 is a panel 16, and one surface of panel 16 can bear verbage such as "lane closed". It is contemplated that the opposite surface of panel 16 can bear the words "lane open", or alternately, can bear advertising copy.

To retain the rod 13 in the central portion of slot 9, a pair of projections 17 extend inwardly from the guide member 6, and define a detent which will engage the rod, and prevent the rod from freely falling to either end of the slot 9.

As shown in FIG. 5, the section 5 of body 4 is formed with a slot 18, which communicates with the socket 11, and on assembly of the ball 12 with socket 11, the rod 13 is inserted in the slot 18.

In the preferred form of the invention, a base 19 is attached to the inner surface of section 5 of body 4, and base 19 is formed with a spherical portion 20, which mates with the spherical socket 11 in the body. In addition, base 19 is formed with a projection 21, which projects outwardly into slot 18, and provides a stop to be engaged by rod 13 when the rod is in slot 10 to maintain the rod at a position flush with the outer surface of section 5.

Base 19 can be attached to the inner surface of section 5 of body 4 by any convenient means, such as an adhesive or auxiliary fasteners.

The sign 1 can be mounted on either a horizontal or vertical surface through a pressure sensitive adhesive 22 on the inner surface of base 19. As illustrated in FIG. 1, body 4 and base 19 are mounted on the vertical surface 23 of side rail 3 of the check-out lane, and rod 13 projects outwardly through the central portion of slot 9, so that the panel 16 extends transversely across the lane 2, and the words "lane closed" face the customer.

If the lane is to be opened, rod 13 can be pivoted horizontally in either direction to position panel 16 generally flat against the rail surface 23, or alternately, the rod can be pivoted vertically, as shown by the dashed lines in FIG. 1 so that the panel extends upwardly from the upper suface of the rail. Rod 13 can then be rotated about its axis to cause the opposite side of panel 16 to face the customer. As previously noted, the opposite surface of panel 16 can bear the term "lane open" or advertising copy. In a similar manner, if the panel is moved to a position flat against the vertical surfaces 23, rod 13 can be rotated about its axis to expose the opposite side of the panel bearing the advertising copy to the customer.

The sign of the invention can be mounted on any vertical, horizontal, or angular surface adjacent the check-out lane. While the drawings have shown the sign mounted on the side rail of the check-out lane, it is also contemplated that it can be mounted on the cash register which is normally positioned adjacent the check-out lane, or any other convenient surface.

While the drawings have similarly illustrated the body having a pair of slots 9 and 10, it is contemplated that only a single slot can be employed. However the combination of slots 9 and 10 provides greater versatility, enabling the panel 16 to be located in various positions with various mounting arrangements.

Various modes of carrying out the invention are contemplated as being within the scope of the following claims particularly pointing out and distinctly claiming the subject matter which is regarded as the invention.

I claim:

1. A sign to be used in conjunction with a shopping lane, comprising a one piece molded body defining a generally spherical socket, said body having an outer surface and an inner surface disposed to be mounted on an object adjacent said lane, the outer surface of said body having a first slot communicating with said socket, a ball disposed within the socket for rotation therein, elongated means connected to the ball and extending outwardly through said slot, movement of said elongated means within said first slot acting to move said elongated means from a first position where said elongated means extends across said lane to a second storage position, said inner surface having a second slot extending between said socket and the exterior of said body, said elongated means being inserted through said second slot as said ball is installed in said socket.

2. The sign of claim 1, wherein the outer portion of said elongated means bears verbage.

3. The sign of claim 1, and including a base attached to the inner surface of said body, said base having a socket portion to mate with the socket of said body.

4. The sign of claim 1, and including means for securing said body to said object.

5. The sign of claim 3, and including means for securing said base to said object.

6. A sign to be associated with a shopping lane, comprising a body defining a generally spherical socket portion, said body having an outer surface and an inner surface disposed to be mounted on an object adjacent said lane, a ball rotatably disposed within the socket portion, said body having a pair of intersecting slots communicating with said socket portion, a rod connected to the ball and extending outwardly through one of said slots, said rod being selectively movable between a first position where said rod is disposed in a first of said slots and extends transversely across said lane and a second position where said rod is disposed in a second of said slots and does not interfere with movement of items on said lane.

7. The sign of claim 6, and including display means connected to the outer end portion of said rod and bearing indicia.

8. The sign of claim 6, wherein one of said slots extends through an arc of approximately 180°, and the second of said slots extends through an arc of approximately 90° and intersects the central portion of said first slot.

9. The sign of claim 6, wherein the inner surface of said body has a recess communicating with said socket portion and disposed to receive said rod on assembly of said ball with said socket portion.

10. The sign of claim 11, and including a base secured to the inner surface of said body and having a socket portion mating with the socket portion of said body.

11. The sign of claim 10, wherein said base has a projection disposed within said recess.

12. A sign to be used in conjunction with a shopping lane, comprising a body defining a generally spherical socket, said body having an outer surface and an inner surface disposed to be mounted on an object adjacent said lane, the outer surface of said body having a slot communicating with said socket, a rotatable member disposed within the socket for rotation therein, a rod connected to the rotatable member and extending outwardly through said slot, said rod being movable within said slot from a first position where said rod extends across said lane to a second storage position, and detent means disposed on said body and extending within said slot, said detent means being spaced from the ends of said slot and constructed and arranged to engage said rod to hold said rod in said first position.

13. The sign of claim 12, wherein said detent means comprises a pair of spaced projections on said body defining a recess to receive said rod.

* * * * *